United States Patent [19]

Sugasawa et al.

[11] 4,274,382

[45] Jun. 23, 1981

[54] APPARATUS FOR PERFORMING STEPWISE REACTIVATION OF CYLINDERS OF AN INTERNAL COMBUSTION ENGINE UPON DECELERATION

[75] Inventors: Fukashi Sugasawa, Yokohama; Haruhiko Iizuka; Junichiro Matsumoto, both of Yokosuka, all of Japan

[73] Assignee: Nissan Motor Company, Limited, Japan

[21] Appl. No.: 34,262

[22] Filed: Apr. 30, 1979

[30] Foreign Application Priority Data

May 12, 1978 [JP] Japan ..... 53-56891

[51] Int. Cl.[3] ..... F02D 5/00; F02D 13/06

[52] U.S. Cl. ..... 123/481; 123/325; 123/493; 123/198 F

[58] Field of Search ..... 123/32 EL, 32 EH, 32 EA, 123/198 F, 198 DB, 97 B

[56] References Cited

U.S. PATENT DOCUMENTS

| | | | |
|---|---|---|---|
| 3,463,130 | 8/1969 | Reichardt et al. | 123/97 B |
| 3,727,591 | 4/1973 | Suda | 123/97 B |
| 4,064,844 | 12/1977 | Matsumoto et al. | 123/32 EA |
| 4,080,947 | 3/1978 | Iizuka | 123/32 EA |
| 4,129,109 | 12/1978 | Matsumoto | 123/32 EA |
| 4,144,864 | 3/1979 | Kato et al. | 123/32 EL |
| 4,173,209 | 11/1979 | Jordan | 123/97 B |

*Primary Examiner*—Charles J. Myhre
*Assistant Examiner*—Andrew M. Dolinar
*Attorney, Agent, or Firm*—Lane, Aitken, Ziems, Kice & Kananen

[57] ABSTRACT

The engine crankshaft rotational speed is detected to be compared with stepwise arranged threshold speeds so as to stepwise enable fuel injection valves of respective cylinders during deceleration of the engine. Accordingly, the number of enabled cylinders is increased in a stepwise manner from a fuel cut-off state as the engine rotational speed decreases to prevent engine stall, while occurrence of shocks upon reactivation of cylinders is avoided. The threshold speeds are controlled in accordance with the variation of engine load which may be increased upon operation of auxiliary power consuming units, such as an air conditioner the compressor of which is driven by the engine, for preventing undesirable vibrations of the engine during the stepwise reactivation of the cylinders.

23 Claims, 6 Drawing Figures

APPARATUS FOR PERFORMING STEPWISE REACTIVATION OF CYLINDERS OF AN INTERNAL COMBUSTION ENGINE UPON DECELERATION

FIELD OF THE INVENTION

This invention generally relates to an apparatus for controlling the number of enabled cylinders of an internal combustion engine. More particularly, the present invention relates to such an apparatus in which the number of enabled cylinders is controlled during deceleration of the engine.

BACKGROUND OF THE INVENTION

In some of conventional internal combustion engines equipped with a fuel injection mechanism, the fuel supply to all of the cylinders of the engine is cut off upon deceleration until the rotational speed of the crankshaft of the engine falls below a predetermined value such as 1,300 r.p.m. inasmush as engine output is not required when the throttle valve of the engine is fully closed. This cut-off of fuel supply results in effective engine braking and improvement of its fuel consumption characteristic. In such an engine, the fuel supply is reestablished when the rotational speed of the engine crankshaft falls below the predetermined value in order to prevent engine stall. According to the above-mentioned apparatus, since all of the cylinders are enabled (fueled) or disabled (non-fueled) at once depending on whether the rotational speed is above or below the predetermined value, the engine produces an impact or shock which will have an effect on the vehicle body. It will be understood that such an impact or shock is uncomfortable for the vehicle occupants.

Furthermore, the predetermined value at which the reactivation of the engine cylinders takes place has to be set at a relatively high value in order to prevent engine stall. However, this predetermined value is preferably as low as possible to improve fuel economy.

The inventors of the present invention had invented an apparatus for controlling the number of enabled cylinders upon decelerating for eliminating the drawbacks and disadvantages inherent to the above-mentioned conventional apparatus before they invented the present invention. The above-mentioned invention invented prior to the present invention will be referred to as prior invention. Although the prior invention is disclosed in a patent application (53-56892) filed with the Japanese Patent Office, the specification has not yet been published. To discuss the objects of the present invention, the technique in the prior invention will be briefly described hereinafter since the subject matter of the present invention resides in the improvement of the apparatus according to the prior invention.

The apparatus according to the prior invention comprises a plurality of comparators responsive to a signal indicative of the engine rotational speed upon deceleration of the engine. The threshold voltages of the comparators are arranged stepwise so that each comparator produces an output signal when the engine speed falls below each threshold voltage. The output signals of the comparators are supplied to logic circuits to control a plurality of switches via which a fuel injection control pulse signal is respectively applied to fuel injection valves to stepwise increase the number of enabled cylinders thereby preventing occurrence of impacts or shocks in the transition period of reactivation of the cylinders upon deceleration.

Assuming that the engine is mounted on a motor vehicle as the prime mover thereof, if the vehicle is not equipped with any auxiliary power consuming units driven by the engine, such as an air conditioner, the apparatus according to the prior invention satisfactorily operates. However, a large number of motor vehicles are actually equipped with auxiliary power consuming units. As is well known, when an air conditioner for a motor vehicle is turned on, the compressor of the air conditioner requires relatively high power so that the engine is needed to feed sufficient power to the compressor. Although the engine may supply sufficient power to the compressor when the engine operates at high speeds, when the number of enabled cylinders is made less than the maximum number of the total cylinders during low speed operation by means of the apparatus according to the prior invention, the engine cannot produce sufficient power that the compressor requires.

Usually, when a motor vehicle is equipped with an auxiliary power consuming unit such as an air conditioner, the engine rotational speed during idling is raised by increasing the flow rate of the intake air to prevent engine stall. Although this technique of elevation of the idling speed is appreciated, the engine still suffers from unstable operation and/or tendency of engine stall during the transition period of the stepwise reactivation of the cylinders since the engine power produced by the enabled cylinders less than the maximum number cannot afford the required power.

This imbalance between the engine power and the required power causes the engine to undesirably vibrate while the engine is still able to operate. Consequently, uncomfortable vibrations are emitted from the engine when the engine produces less power than required during the stepwise reactivation of the cylinders. This phenomenon of production of the undesirable vibrations continuously lasts until all of the cylinders are enabled.

SUMMARY OF THE INVENTION

The present invention has been developed in order to eliminate the above described drawbacks and disadvantages inherent to the apparatus for controlling the number of enabled cylinders according to the before mentioned prior invention.

It is, therefore, an object of the present invention to provide an apparatus for controlling the number of enabled cylinders of an internal combustion engine in which the undesirable vibrations are prevented from being produced even though the load of the engine is increased upon operation of auxiliary power consuming units during the stepwise reactivation of the cylinders.

Another object of the present invention is to provide such an apparatus in which engine operation is made stable during the stepwise reactivation of the cylinders.

A further object of the present invention is to provide such an apparatus in which engine stall during the stepwise reactivation is avoided.

A still further object of the present invention to provide such an apparatus in which fuel economy is improved.

For achieving the above-described objects, the stepwise arranged thresholds of the comparators are controlled in accordance with the variation of the engine load which may be increased by operations of auxiliary power consuming units.

BRIEF DESCRIPTION OF THE DRAWINGS

These and other objects and features of the present invention will become more readily apparent from the following detailed description of the preferred embodiments taken in conjunction with the accompanying drawings in which.

DETAILED DESCRIPTION OF THE PREFERRED EMBODIMENTS

Prior to describing the preferred embodiments of the apparatus for controlling the number of enabled cylinders in accordance with the present invention, the construction and operation of the apparatus according to the before mentioned prior invention will be discussed hereinbelow for a better understanding of the objects of the present invention.

Figure 1:
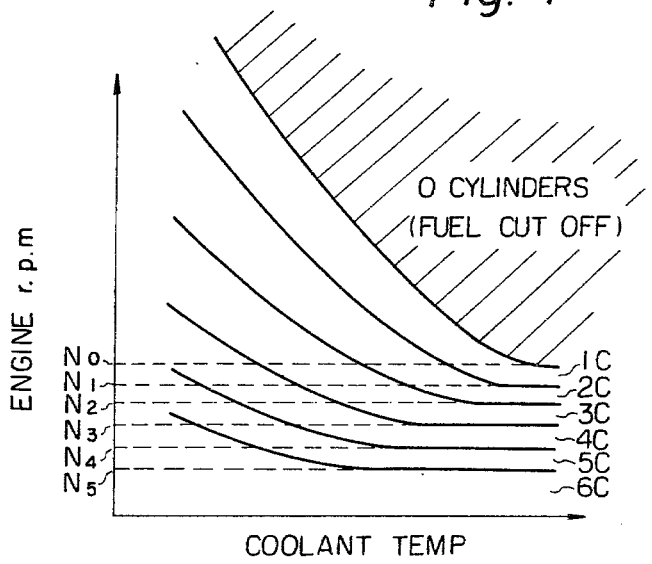
FIG. 1 and FIG. 2 are graphs showing the thresholds at which reactivation of cylinders of an engine occurs in the control of the first embodiment of the apparatus according to the present invention.

FIG. 1 is a graph showing the control of a first embodiment of an apparatus according to the prior invention. As shown in FIG. 1, there are stepwise arranged threshold speeds at which reactivation of cylinders take place. The control shown in FIG. 1 is designed for a six-cylinder engine and therefore, the number of steps of the stepwise control is six. The thresholds are made engine temperature dependent in a manner that the thresholds increase as the engine temperature decreases. In the hatched area, none of the cylinders is supplied with fuel during deceleration. As the rotational speed N of the engine crankshaft decreases and reaches a first threshold speed $N_0$, one cylinder is enabled. As the engine speed N further decreases and becomes below the second threshold speed $N_1$, two cylinders are enabled. In this way the number of enabled cylinders is stepwise increased as the engine crankshaft rotational speed N decreases. When the engine speed N finally reaches the sixth threshold speed $N_5$, all of the cylinders $C_1$ to $C_6$ are enabled to produce sufficient power to prevent engine stall. The threshold speeds $N_0$ to $N_5$ at normal engine temperatures are fixedly predetermined while these thresholds are changed in accordance with the engine temperature variations. In other words, the values of these thresholds are determined by only the engine temperature and, therefore, these thresholds are not affected by the change in the engine load.

Figure 2:
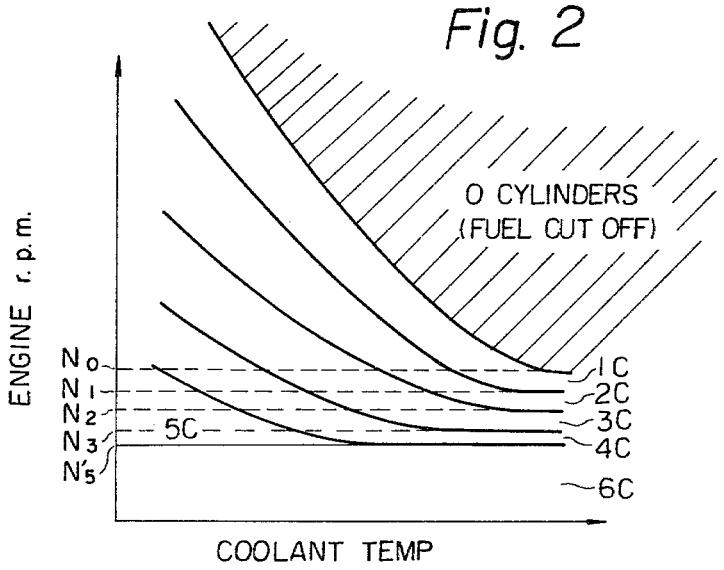

FIG. 2 is a graph showing the control obtained by a first preferred embodiment of an apparatus according to the present invention. In the illustrated example, the first to fourth threshold speeds $N_0$ to $N_3$ at the normally high temperatures are the same as in the control shown in FIG. 1. However, a critical point or speed $N'_5$ is additionally provided below the fourth threshold speed $N_3$. This critical point $N'_5$ is set to correspond to an engine speed below which engine vibrations are apt to increase upon deactivation of some of the cylinders during deceleration when the auxiliary power consuming unit is operating. The value of the critical speed $N'_5$ may be changed in accordance with power required by the auxiliary power consuming unit. It will be understood that the apparatus according to the present invention performs the control of FIG. 1 when the auxiliary power consuming unit is turned off and performs the control of FIG. 2 when the auxiliary power consuming unit is turned on.

Figure 3:
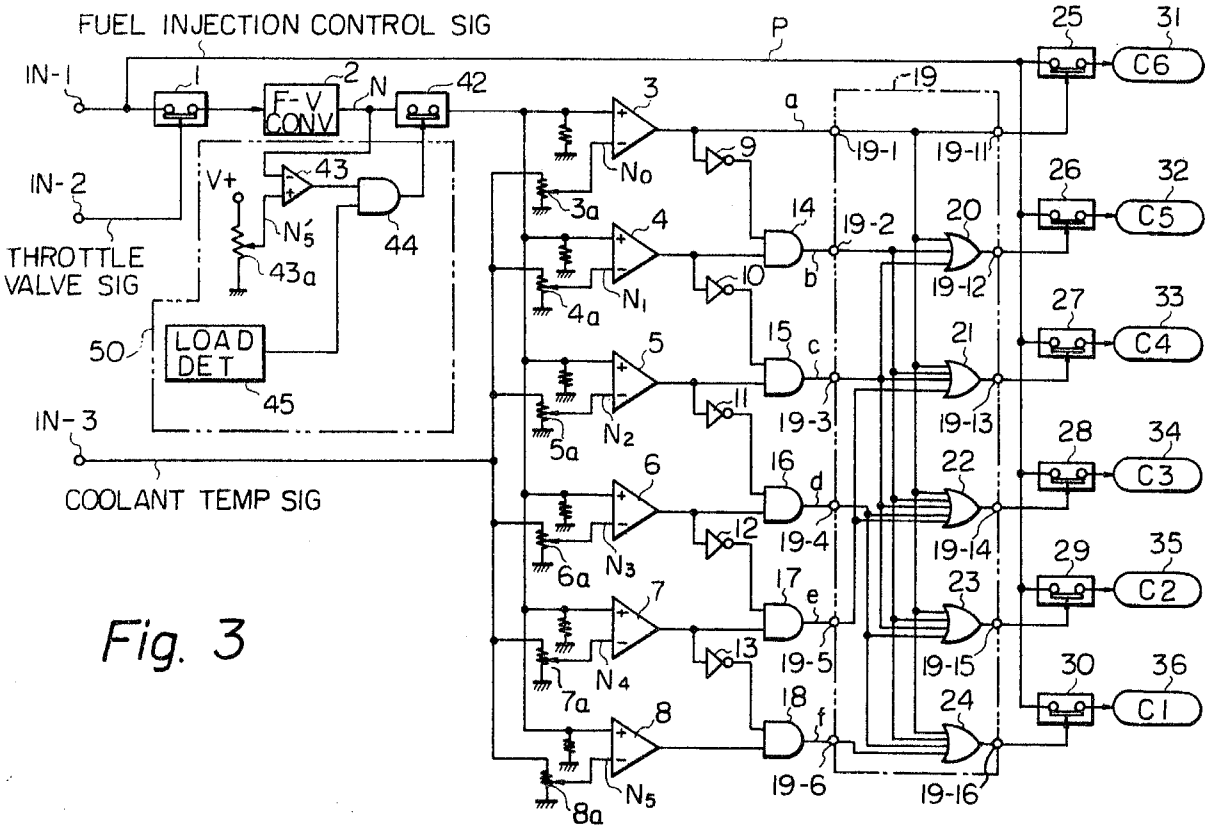
FIG. 3 shows a schematic circuit diagram of the first embodiment of the apparatus according to the present invention for achieving the controls of FIG. 1 and FIG. 2.

Hence, reference is now made to FIG. 3 which shows a schematic circuit diagram of the first embodiment of the apparatus for controlling the number of enabled cylinders according to the present invention. The circuit includes switches 1 and 42, a frequency to voltage (F-V) converter 2, a switching control circuit 50, a series of comparators 3 to 8, a series of variable resistors *3a* to *8a*, a series of NOT gates (inverters) 9 to 13, a series of AND gates 14 to 18, a decoder 19, and a series of switches 25 to 30. It is assumed that the internal combustion engine (not shown) which is controlled by the circuit shown in FIG. 3 is of a fuel injection type and has six cylinders. Accordingly, six fuel injection valves 31 to 36 are provided in respective intake manifolds communicating with respective cylinders. These fuel injection valves 31 to 36 are respectively controlled by a fuel injection control pulse signal "P" which is generated by a conventional fuel injection control pulse generator (not shown) and this pulse signal "P" is applied to the circuit via a first input terminal IN-1. The series of switches 25 to 30 as well as the switch 1 may be relays or electronic switches. The series of switches 25 to 30 are of a normally-closed type and are arranged to open (turn off) in response to gate signals supplied from the decoder 19. In other words, the fuel injection valves 31 to 36 are so controlled by the fuel injection control pulse signal "P" that all of the cylinders are enabled unless gate signals are applied from the decoder 19.

The fuel injection control pulse signal "P" is applied via the switch 1 to an input of the frequency to voltage converter 2. The switch 1 is controlled by a throttle valve signal applied via a second input terminal IN-2. The throttle valve signal is produced by a well known throttle valve opening degree sensor, such as a potentiometer operatively connected to the shaft of the throttle flap (not shown). The output of the throttle valve opening degree sensor is connected to a threshold circuit such as a comparator to produce a high level signal when the opening degree of the throttle flap is below a predetermined value. In other words, a high level signal is applied to the switch 1 to close the contacts thereof only when the throttle valve is fully closed to feed the fuel injection control pulse signal "P" to the input of the frequency to voltage converter 2. The frequency to voltage converter 2 produces an analogue signal indicative of the rotational speed N of the crankshaft of the engine since the frequency of the injection pulse signal "P" represents the engine rotational speed. Of course, a suitable signal indicative of the engine r.p.m. may be used in place of the fuel injection control pulse signal P. For instance, an engine r.p.m. signal derived from a tachometer generator may be used.

The output of the frequency to voltage converter 2 is connected via the switch 42 to noninverting inputs (+) of the first to sixth comparators 3 to 8. A resistor is interposed between each of the noninverting inputs (+) of each of comparators 3 to 8 and ground. Each of the comparators 3 to 8 has an inverting input (−) connected to the movable contact of each of the variable resistors 3a to 8a. The variable resistors 3a to 8a may be voltage dividers having two end terminals and a center tap. Each of the variable resistors 3a to 8a is interposed between the third input terminal IN-3 and ground. The third input terminal IN-3 is responsive to an engine coolant temperature signal which may be produced by a suitable temperature sensor such as a thermistor disposed in the water jacket of the engine to be exposed to the coolant of the engine. The movable contacts of the respective variable resistors 3a and 8a are so adjusted that respective predetermined voltages are developed when a predetermined voltage is applied to the third input terminal IN-3. These voltages produced by the series of variable resistors 3a to 8a are arranged stepwise to be used as stepwise reference or threshold voltages by the comparators 3 to 8. Since the voltage applied to the third input terminal IN-3 indicates the temperature of the engine (coolant), the voltage applied to respective variable resistors 3a to 8a varies in accordance with the variation of the engine temperature. The reference or threshold voltages are arranged to respectively correspond to predetermined rotational speeds $N_0$ to $N_5$ of the crankshaft of the engine in a manner that the value of $N_0$ is higher than the value of $N_5$. For instance, the threshold voltages are set to correspond to the respective rotational speeds of the engine as follows: $N_0=1{,}300$ r.p.m.; $N_1=1{,}200$ r.p.m.; $N_2=1{,}100$ r.p.m.; $N_3=1{,}000$ r.p.m.; $N_4=900$ r.p.m.; and $N_5=800$ r.p.m. It is to be noted that the circuit shown in FIG. 3 is designed to be used for controlling a six-cylinder engine so that the maximum number of steps in the stepwise control is six. Accordingly, the maximum number of steps in the stepwise control will follow the number of cylinders of an engine. The number of the steps in the stepwise control is determined by the number of the comparators 3 to 8 and therefore, the number of the comparators may be increased or decreased in accordance with the number of the cylinders of an engine.

Each of the comparators 3 to 8 produces a high (logic "1") level output signal when the voltage of the signal from the frequency to voltage converter 2 exceeds respective thresholds. In other words, each comparator 3 to 8 produces a high level signal when the rotational speed N of the engine crankshaft exceeds respective threshold speeds $N_0$ to $N_5$ and a low (logic "0") level signal when the rotational speed N is equal to or below the respective threshold speeds $N_0$ to $N_5$. The output of the first comparator 3 is connected to a first input 19-1 of the decoder 19, and is further connected via a first NOT gate 9 to a first input of a first AND gate 14 the output of which is connected to a second input 19-2 of the decoder 19 in turn. The output of the second comparator 4 is connected to a second input of the first AND gate 14 and is further connected via a second NOT gate 10 to a first input to a second AND gate 15 the output of which is connected to a third input 19-3 of the decoder 19. In the same manner the outputs of the third to fifth comparators 5 to 7 are respectively connected to the second to fifth AND gates 15 to 18 the outputs of which are respectively connected to third to sixth inputs 19-3 to 19-6 of the decoder 19. The output of the sixth comparator 8 is connected to a second input of the sixth AND gate 18.

The decoder 19 has the above-mentioned six inputs 19-1 to 19-6, five OR gates 20 to 24, and six outputs 19-11 to 19-16. The first input 19-1 is directly connected to the first output 19-11 and is further connected to an input of all of the OR gates 20 to 24. The second input 19-2 of the decoder 19 is connected to an input of each of the OR gates 20 to 24, while the third input 19-3 is connected to inputs of first to fourth OR gates 20 to 23. The fourth input 19-4 is connected to inputs of third to sixth OR gates 22 to 24, while the fifth input 19-5 is connected to inputs of the second and third OR gates 21 and 22. The sixth input 19-6 is connected to an input of the fifth OR gate 24. The outputs of the first to fifth OR gates 20 to 24 are respectively connected to the second to sixth outputs 19-12 to 19-16 of the decoder 19. The first to sixth outputs 19-11 to 19-16 of the decoder 19 are respectively connected to first to sixth switches 25 to 30 to control the switching operation of the same.

The second switch 42 is controlled by the switching control circuit 50. As will be described hereinlater the apparatus according to the before mentioned prior invention does not have such switch 42. In other words the switch 42 is additionally provided in the present invention. The switching control circuit 50 comprises a comparator 43, an AND gate 44 and a load detector 45 and produces a control signal by which the second switch 42 is controlled. The output of the frequency to voltage converter 2 is connected to an inverting input (−) of the comparator 43 which has a noninverting input (+) connected to a movable contact of a variable resistor 43a. The variable resistor 43a is interposed between a positive power supply $V_+$ and ground to develop a predetermined voltage at the movable contact to supply the comparator 43 with a reference voltage. The output of the comparator 43 is connected to an input of the AND gate 44 the output of which is connected to a control terminal of the switch 42. The AND gate 44 has a second input connected to an output of the load detector 45. The load detector 45 is responsive to at least one auxiliary power consuming unit to produce an output signal. For instance the load detector 45 comprises a switch responsive to the operation of the compressor of the air conditioner installed in a motor vehicle whose prime mover is the engine controlled by this apparatus. The load detector 45 is arranged to produce a high (logic "1") level output signal when the auxiliary power consuming unit is turned on.

The circuit shown in FIG. 3 operates as follows. In order to relieve features of the present invention with respect to the prior invention, the following description will be first made just ignoring the switch 42. (In other words, it is assumed that the switch 42 is closed.) It is assumed that the throttle valve is fully closed to decelerate the engine so that the switch 1 is closed to transmit the fuel injection control pulse signal "P" to the frequency to voltage converter 2. The voltage of the output signal of the frequency to voltage converter 2 indicates the rotational speed N of the crankshaft of the engine and this signal is applied to all of the comparators 3 to 8. When the rotational speed of the engine is above the first threshold rotational speed $N_0$, i.e. the frequency to voltage converter output voltage is over the highest threshold voltage fed from the first variable resistor 3a, all of the comparators 3 to 8 produce high (logic "1") level output signals. This high level output signal of the first comparator 3 is applied to the first input 19-1 of the decoder 19 so that the decoder 19 produces high level output signals at all of the outputs 19-11 to 19-16. These high level signals from the decoder 19 are respectively applied to the switches 25 to 30 as gate signals to open (turn off) the contacts thereof.

Consequently, the fuel injection control pulse signal "P" is not fed to the respective fuel injection valves 31 to 36 and therefore, the fuel supply to all cylinders of the engine is disabled. Of course if the throttle valve is not fully closed, the switch 1 remains open and therefore, the frequency to voltage converter 2 produces an output analogue signal of low voltage. In this case none of the comparators 3 to 8 produces high level output signals so that all of the switches 25 to 30 are left closed to transmit the fuel injection control pulse signal "P" to the fuel injection valves 31 to 36. Accordingly, fuel cut-off (deactivation) takes place only when the throttle valve is fully closed, i.e. upon deceleration. The operation of the circuit will be described hereinbelow under an assumption that the switch 1 is closed upon detection of deceleration of the engine.

As the rotational speed of the crankshaft of the engine decreases and when the speed falls below the first threshold $N_0$ but above the second threshold speed $N_1$, the output signal of the first comparator 3 assumes a low (logic "0") level, while the remaining comparators 4 to 8 still produce high level output signals. The low level output signal of the first comparator 3 is inverted into a high level signal by the first NOT gate 9 to be applied to the first input of the first AND gate 14. Since the first AND gate 14 receives a high level output signal from the second comparator 4, the AND gate 14 transmits a high level signal to the second input 19-2 of the decoder 19. The high level signal applied to the second input 19-2 of the decoder 19 is delivered via the first to fifth OR gates 20 to 24 to the second to six outputs 19-12 to 19-16 of the decoder 19, while a low level output signal is developed at the first output 19-11. Accordingly, only the first switch 25 is turned on to permit the transmission of the fuel injection control pulse signal "P". With this operation, the fuel supply to the sixth cylinder C6 is reestablished, i.e. the sixth cylinder C6 is enabled, while the remaining cylinders C1 to C5 are left disabled.

When the engine crankshaft rotational speed N further decreases below the second threshold speed $N_1$ but above the third threshold speed $N_2$, the first and second comparators 3 and 4 produce low level output signals, while the remaining comparators 5 and 8 produce high level output signals. In this case only the second AND gate 15 produces a high level output signal and this high level signal is fed to the third input 19-3 of the decoder 19. The high level signal applied to the third input 19-3 is transmitted via the first to fourth OR gates 20 to 23 to the second to fifth outputs 19-12 to 19-15. Therefore, the first and sixth switches 25 and 30 are closed while second to fifth switches 26 to 29 remain open. Accordingly, the first and sixth cylinders C1 and C6 are enabled, while the remaining cylinders C2 to C5 are prevented from being supplied with fuel. In this way the number of enabled cylinders increases as the rotational speed of the crankshaft of the engine decreases upon deceleration. After the engine speed N has finally reached the sixth threshold speed $N_5$, all of the cylinders C1 to C6 are supplied with fuel so that all of the cylinders are enabled to produce respective power.

The fifth threshold speed $N_5$ is set above the lowest possible speed so that all of the cylinders C1 to C6 are supplied with fuel when the engine crankshaft rotates at the lowest possible speed, such as the idling speed. With this arrangement the engine rotates smoothly during idling, while the tendency to engine stall is avoided.

Although the circuit shown in FIG. 3 performs the stepwise reactivation of the cylinders in six steps, the number of the steps may be reduced if desired even though the engine has six cylinders.

In the above, the operation of the circuit shown in FIG. 3 has been described under an assumption that the switch 42 is closed or such switch does not exist. However, actually the switch 42 is provided to temporarily block the output signal of the frequency to voltage converter 2. The comparator 43 included in the switching control circuit 50 is responsive to the output signal of the frequency to voltage converter 2 to produce a high level signal when the engine rotational speed N is below a predetermined speed $N'_5$ defined by the voltage of the reference voltage produced by the variable resistor 43*a*. The predetermined speed $N'_5$ is arranged to correspond to the critical point or speed shown in FIG. 2. Since the AND gate 44 is responsive to the output of the comparator 43 and the output signal of the load detector 45, the AND gate 44 produces a high level signal when the auxiliary power consuming unit is turned on and the engine r.p.m. is below the critical point (speed) $N'_5$. The second switch 42 is responsive to the output signal of the AND gate 44 to open the contacts thereof when a high level signal is applied thereto from the AND gate 44.

When the switch 42 becomes nonconductive, the output signal of the frequency to voltage converter 2 is not fed to the series of comparators 3 to 8 any longer and therefore, all of the comparators 3 to 8 produce low level signals. This state is the same as that when the switch 1 is open as described hereinabove. Namely, when the switch 42 becomes nonconductive, the output signals of the decoder 19 assume low levels to render the switches 25 to 30 conductive. Accordingly, all of the fuel injection valves 31 to 36 are enabled to supply fuel to the cylinders so that all of the cylinders C1 to C6 are enabled.

Assuming that the critical speed $N'_5$ is set between the fourth and fifth threshold speeds $N_3$ and $N_4$, the stepwise control (reactivation) of the cylinders takes place until the engine rotational speed N falls below the fourth threshold speed $N_3$. As the engine r.p.m. further falls, reaching the critical speed $N'_5$, all of the cylinders C1 to C6 are enabled. In other words, the number of the enabled cylinders increases one by one until four cylinders are enabled and then all (six) cylinders are enabled upon deceleration when the auxiliary power consuming unit is operating.

When the engine temperature is low, the fifth threshold speed $N_4$ assumed a higher level, as shown in FIG. 2, than the critical speed $N'_5$ since all of the threshold speeds $N_0$ to $N_5$ are raised in accordance with the temperature decrease. In this case, the fifth comparator 7 produces a high level signal before the comparator 43 produces a high level signal while the engine rotational speed N continuously decreases. Therefore, after the four cylinders are enabled, five cylinders are enabled before all of the cylinders C1 to C6 are enabled.

Figure 4:
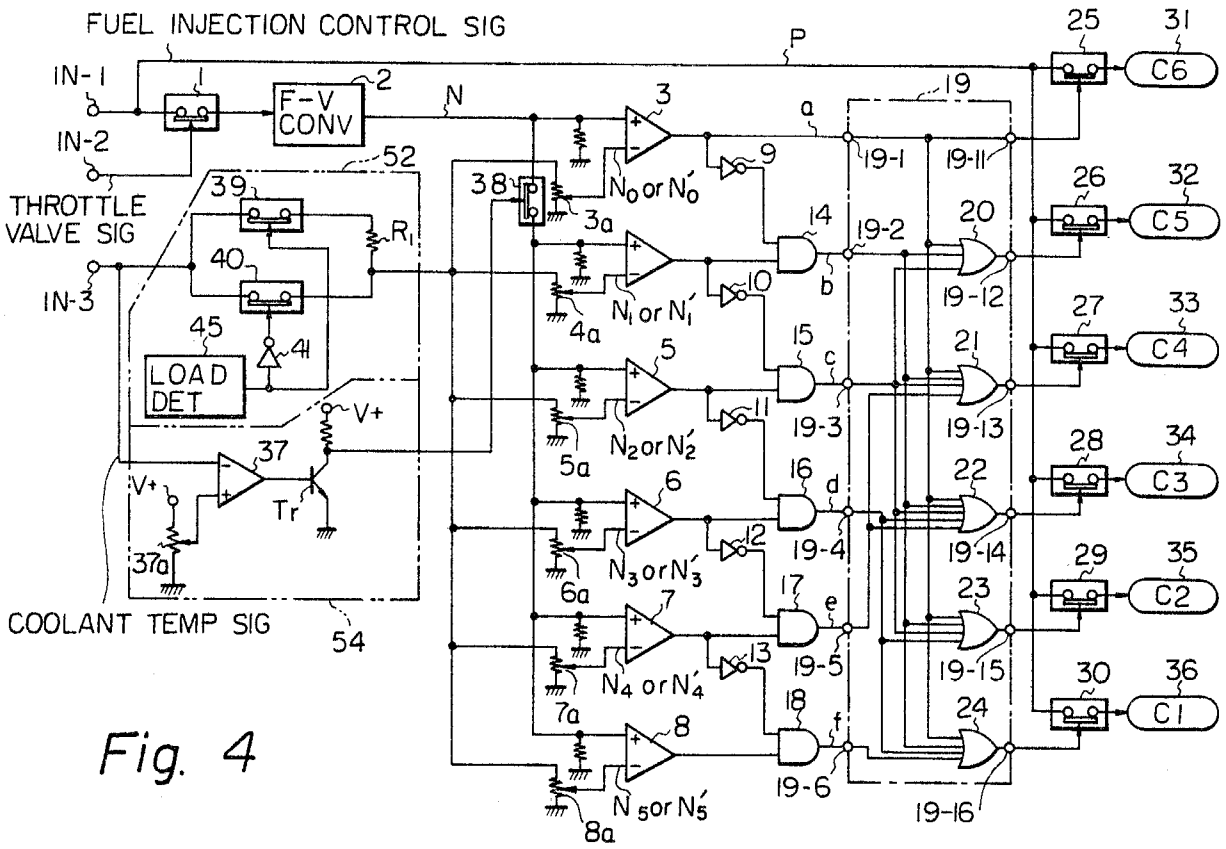
FIG. 4 shows a schematic circuit diagram of the second embodiment of the apparatus according to the present invention.

Reference is now made to FIG. 4 which shows a second preferred embodiment of the apparatus for controlling the number of enabled cylinders according to the present invention. The second embodiment apparatus is provided for performing the stepwise control shown in FIGS. 5 and 6. The circuit arrangement of the second embodiment is the same as that of the first embodiment except that a switch 38 is interposed in the input circuits of the second to sixth comparators 4 to 8 while the switch 2 and relating circuits are omitted and a switching circuit 52 is additionally provided between the third input terminal IN-3 and the variable resistors 3*a* to 8*a*. The switch 38 is controlled by a switching control signal produced in a switching control circuit 54 which is also additionally provided. Other elements and circuits in the second embodiment are the same as those in the first embodiment and these elements and circuits are designated by the same reference numerals.

The switching circuit 52 comprises first and second switches 39 and 40, which are of a normally-closed type, a resistor $R_1$, a load detector 45 and a NOT gate (inverter) 41. The first and second switches 39 and 40 respectively have first and second stationary contacts and movable contacts arranged to electrically connect the first and second stationary contacts upon energization. The first stationary contacts of the first and second switches 39 and 40 are connected to the third input terminal IN-3. The second stationary contact of the first switch 39 is connected via the resistor $R_1$ to one end terminal of each of the resistors 3*a* to 8*a*, while the second stationary contact of the second switch 40 is directly connected to the same end terminals of the variable resistors 3*a* to 8*a*. The load detector 45 is the same as in the first embodiment and produces a high level signal upon detection that the auxiliary power consuming unit is operating. The output of the load detector 45 is directly connected to the control terminal of the first switch 39 and is connected via a NOT gate 41 to the control terminal of the second switch 40. Although the first and second switches 39 and 40 are shown to be mechanical switches such as relays, electronic gating circuits or switches may be used instead.

The switching control circuit 54 includes a comparator 37 and a switching transistor Tr. The comparator 37 has an inverting input (−) connected to the third input IN-3 and a noninverting input (+) connected to a voltage divider or a variable resistor 37*a*. The output of the comparator 37 is connected to a base of the transistor T4 the emitter of which is connected to ground. The collector of the transistor Tr is connected via a resistor to a positive power supply V+. The variable resistor 37*a* is interposed between the positive power supply V+ and ground to develop a predetermined reference voltage at the movable contact thereof. This predetermined voltage is fed to the noninverting input (+) of the comparator 37. The collector of the transistor Tr is connected to the switch 38 to control the switching function thereof. The switch 38 may be a relay or an electronic switching device.

The second embodiment apparatus shown in FIG. 4 operates as follows. In the following description of the operation, only the different points with respect to the first embodiment will be described. Firstly, it is assumed that the auxiliary power consuming unit is not operating and therefore, the load detector 45 produces a low level output signal. The low level output signal of the load detector 45 is inverted into a high level signal by the NOT gate 41 so that the second switch 40 is opened (turned off). Upon reception of the low level signal from the load detector 45, the first switch 39 remains closed to transmit the coolant temperature signal applied to the third input terminal IN-3 via the resistor $R_1$ to the end terminal of each of the variable resistors 3*a* to 8*a*. The voltage of the coolant temperature signal is reduced by a predetermined value corresponding with the voltage drop across the resistor $R_1$ so that the voltage applied to all of the variable resistors 3*a* to 8*a* are lower than the voltage at the third input terminal IN-3.

Figure 5:
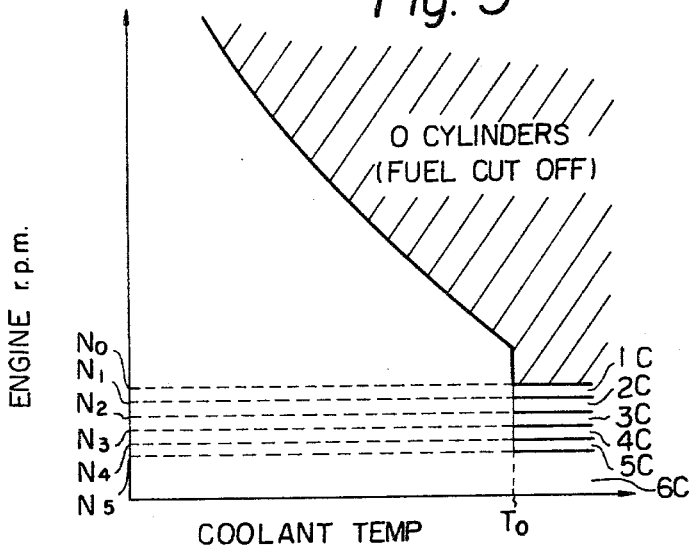
FIG. 5 and FIG. 6 are graphs showing the thresholds at which reactivation of cylinders of an engine occurs in the control of the second embodiment shown in FIG. 4.

When the engine temperature is extremely low, the voltage of the engine coolant temperature signal is high. When the voltage of the coolant temperature signal is above the predetermined voltage applied to the noninverting input (+) of the comparator 37, the comparator 37 produces a low (logic "0") level signal. This predetermined voltage is so set by the variable resistor 37*a* that it corresponds to a predetermined temperature "$T_o$" which is shown in FIG. 5. With this provision, the comparator 37 produces a low level signal only when the engine temperature is below the predetermined temperature "$T_o$".

The low level signal from the comparator 37 is supplied to the base of the transistor Tr to render the transistor Tr nonconductive (OFF). Upon turning off of the transistor Tr the voltage at the collector of the transistor Tr rises so that a high level signal is applied to the switch 38 to turn off the same. The switch 38 becomes nonconductive to block the transmission of the output signal, indicative of the engine rotational speed N, of the frequency to voltage converter 2 to the second to sixth comparators 4 to 8. In other words, only the first comparator 3 receives the output signal of the frequency to voltage converter 2. The first comparator 3, therefore, detects whether the engine rotational speed N is above or below the first threshold speed $N_0$ to produce a high or low level signal in the same manner as in the first embodiment. Meanwhile, the second to sixth comparators 4 to 8 produce low (logic "0") level signals upon receiving no input signals at the noninverting inputs (+) thereof. Accordingly, the first to fifth AND gates 14 to 18 produce low level signals "b" to "f" in receipt of low level signals from the second to sixth comparators 4 to 8. Namely, the input signals "a" to "f" of the decoder 19 will be expressed in logic levels as 1-0-0-0-0-0 when the engine rotational speed N is above the first threshold speed $N_0$; and as 0-0-0-0-0-0 when the engine rotational speed N is equal to or below the first threshold speed $N_0$. Therefore, the output signals of the decoder 19 assumes either 1-1-1-1-1-1 or 0-0-0-0-0-0 depending on the engine rotational speed N. This means that all of the cylinders are either supplied with fuel or not depending on the engine r.p.m. when the coolant temperature is below the before mentioned predetermined value "$T_o$" upon deceleration.

On the other hand when the coolant temperature is above the predetermined value "$T_o$", the comparator 37 produces a high level signal to render the transistor Tr conductive (ON) so that the switch 38 is turned on to supply the output signal of the fequency to voltage converter 2 to the second to sixth comparators 4 to 8. In this temperature range, i.e. above the predetermined value "$T_o$", the first to sixth comparators 3 to 8 function in the same manner as in the first embodiment to stepwise increase the number of enabled cylinders as the rotational speed of the engine decreases.

It should be remembered that the above described operation of the second embodiment is performed when the auxiliary power consuming unit is not operating. Now the operation of the circuit will be made under an assumption that the auxiliary power consuming unit is operating. In this case the load detector 45 produces a high level signal as described hereinabove. The high level signal causes the first switch 39 to turn off, while the high level signal is inverted into a low level signal by the NOT gate 41 so that the second switch 40 remains closed. With this switching operation, the engine coolant temperature signal applied to the third input terminal IN-3 is directly applied via the second switch 40 to the series of variable resistors 3*a* to 8*a*. Consequently, the voltage applied to the variable resistors 3*a* to 8*a* is higher than that applied via the resistor $R_1$. The application of the higher voltage to all of the variable resistors 3*a* to 8*a* causes the variable resistors 3*a* to 8*a* to develop higher threshold voltages. This means that the threshold speeds $N_0$ to $N_5$ used by the comparators 3 to 8 are raised (elevated) by a predetermined value. In other words, a series of higher threshold speeds $N'_0$ to $N'_5$ are used in place of the threshold speeds $N_0$ to $N_5$.

Figure 6:
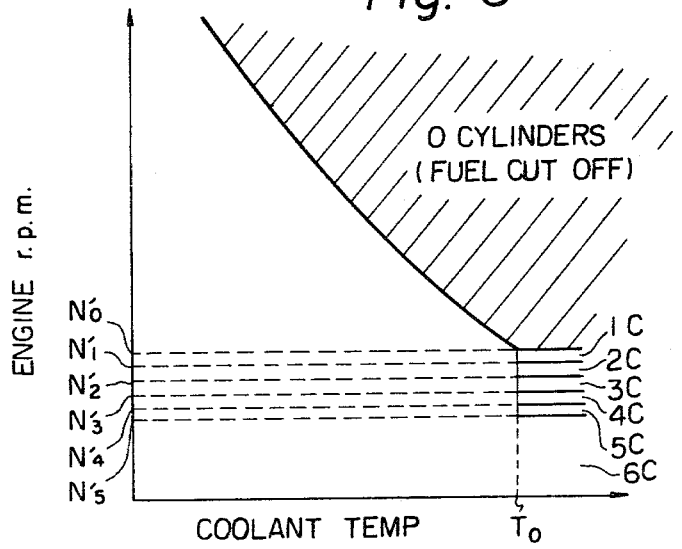

FIG. 6 shows the above-mentioned control with the raised threshold speeds $N'_0$ to $N'_5$. Comparing the controls shown in FIG. 5 and FIG. 6, it will be understood that the engine produces more power when the auxiliary power consuming unit is operated during the transient period of stepwise reactivation of the cylinders C1 to C6. Therefore, the occurrence of undesirable vibrations is prevented.

When the engine temperature is below the predetermined value "$T_o$", the stepwise reactivation is not performed and all of the cylinders C1 to C6 are enabled at once when the engine rotational speed N falls below the threshold speed determined in accordance with the engine temperature. This operation is the same as that described hereinabove in connection with FIG. 5 and therefore repetition of the description is omitted.

Although in the above described embodiments, the load detector 45 shown in FIGS. 3 and 4 is responsive to the operation of at least one auxiliary power consuming unit, such as the compressor of an air conditioner, other circuit which detects the increase in the engine load may be used instead.

From the foregoing, it will be understood that all of the cylinders C1 to C6 are enabled at a higher threshold speed, when the auxiliary power consuming unit requires engine power, than the lowest threshold speed at which all of the cylinders are enabled when the auxiliary power consuming unit is not operating.

What is claimed is:

1. Apparatus for controlling the number of enabled cylinders of an internal combustion engine having a plurality of cylinders during deceleration, comprising:

(a) first means for producing a first signal indicative of the rotational speed of a crankshaft of said engine;

(b) second means for producing a second signal indicative of deceleration of said engine;

(c) a plurality of threshold detecting circuits having respective inputs and outputs, said inputs being connected to said first means for producing respective output signals responsive to said first signal at each of said outputs, the thresholds of said detecting circuits being arranged stepwise;

(d) a plurality of switching means respectively responsive to the output signals of said threshold detecting circuits for stepwise increasing the number of enabled cylinders as said engine decelerates;

(e) third means responsive to said second signal for enabling the stepwise increase upon deceleration of said engine;

(f) fourth means for producing a third signal when the load of said engine is increased; and (g) fifth means for enabling all of said cylinders when the engine rotational speed falls below a predetermined value which is above the lowest threshold of said threshold detecting circuit upon presence of said third signal.

2. Apparatus as claimed in claim 1, wherein said fifth means comprises:

(a) means for producing a fourth signal when the engine rotational speed is below said predetermined value; and (b) switching means interposed in the input circuits of said threshold detecting circuits for blocking said first signal upon presence of said third and fourth signals.

3. Apparatus as claimed in claim 1, wherein said first means comprises: (a) means for generating a pulse signal responsive to the rotational speed of a crankshaft of said engine; and (b) a frequency to voltage converter responsive to said pulse signal for producing said first signal.

4. Apparatus as claimed in claim 1, wherein said second means comprises a potentiometer operatively connected to a throttle valve of said engine.

5. Apparatus as claimed in claim 1, wherein each of said threshold detecting circuits comprises a comparator and a voltage divider for producing a reference signal for said comparator.

6. Apparatus as claimed in claim 1, wherein a fuel injection valve is disposed in an intake passage communicated with each cylinder.

7. Apparatus as claimed in claim 6, including means for generating a control signal for said fuel injection valves, wherein each of said switching means selectively transmits said control signal to each of said fuel injection valves for achieving selective fuel supply to each cylinder.

8. Apparatus as claimed in claim 1, further comprising logic circuits interposed between said threshold detecting circuits and said switching means for producing a plurality of combinations of logic signals by which said switching means are controlled.

9. Apparatus as claimed in claim 8, wherein said threshold detecting circuits comprise first to sixth comparators, and wherein said logic circuits comprise:

(a) first to fifth NOT gates respectively connected to the outputs of said first to fifth comparators;

(b) first to fifth AND gates, each of which has first and second inputs, the first inputs of said first to fifth AND gates being connected respectively to the outputs of said first to fifth NOT gates, the second inputs of said first to fifth AND gates being connected respectively to the outputs of said second to sixth comparators;

(c) first to fifth OR gates, the output of said first comparator being connected to inputs of said first to fifth OR gates, the output of said first AND gate being connected to inputs of said first to fifth OR gates, the output of said second AND gate being connected to inputs of said first to fourth OR gates, the output of said third AND gate being connected to inputs of said third to fifth OR gates, the output of said fourth AND gate being connected to inputs of said second and third OR gates, the output of said fifth AND gate being connected to an input of said fifth OR gate, the output of said first comparator and the outputs of said first to fifth OR gates being respectively connected to said switching means.

10. Apparatus as claimed in any one of claims 1 to 9, further comprising means for varying the thresholds of said thresholds detecting circuits in accordance with engine temperature.

11. Apparatus for controlling the number of enabled cylinders of an internal combustion engine during deceleration, comprising:

(a) first means for producing a first signal indicative of the rotation speed of a crankshaft of said engine;

(b) second means for producing a second signal indicative of deceleration of said engine;

(c) a plurality of threshold detecting circuits having respective inputs and outputs, said inputs being connected to said first means for producing respective output signals responsive to said first signal at each of said outputs, the thresholds of said detecting circuits being arranged stepwise;

(d) a plurality of switching means respectively responsive to the output signals for said threshold detecting circuits for stepwise increasing the number of enabled cylinders as said engine decelerates;

(e) third means responsive to said second signal for enabling the stepwise increase upon deceleration of said engine;

(f) fourth means for producing a third signal when the load of said engine is increased;

(g) fifth means responsive to said first signal for producing a fourth signal when the engine rotational speed is below a predetermined value which is above the lowest threshold of said threshold detecting circuit;

(h) an AND gate responsive to said third and fourth signals; and (i) a switching circuit interposed between said first means and said threshold detecting circuits, said switching circuit being responsive to the output signal of said AND gate.

12. Apparatus for controlling the number of enabled cylinders of an internal combustion engine having a plurality of cylinders during deceleration, comprising:

(a) first means for producing a first signal indicative of the rotational speed of a crankshaft of said engine;

(b) second means for producing a second signal indicative of deceleration of said engine;

(c) third means responsive to said first signal for producing a plurality of control signals, the number of which varies progressively in response to said first signal;

(d) fourth means responsive to said second signal for enabling said third means to produce said control signals upon deceleration of said engine;

(e) a plurality of switching means respectively responsive to each of said control signals for respectively disabling each of said cylinders;

(f) fifth means for generating a third signal indicative of the running of at least one auxiliary power consuming unit driven by said engine; and (g) sixth means responsive to said third signal for decreasing the number of said control signals so as to increase the number of enabled cylinders for compensating the load increasing caused by the operation of said power consuming unit.

13. Apparatus as claimed in claim 12, wherein said sixth means comprises a means for disabling the transmission of said first signal upon presence of said third signal.

14. Apparatus as claimed in claim 12, wherein said first means comprises:

(a) means for producing a pulse signal responsive to the rotational speed of a crankshaft of said engine; and (b) a frequency to voltage converter responsive to said pulse signal for producing said first signal.

15. Apparatus as claimed in claim 12, wherein said second means comprises a potentiometer operatively connected to a throttle valve of said engine.

16. Apparatus as claimed in claim 14, wherein said fourth means comprises a switching means responsive to said second signal disposed between said means for producing a pulse signal and said frequency to voltage converter.

17. Apparatus as claimed in claim 12, wherein said third means comprises:

(a) an analog to digital converter responsive to said first signal for producing coded digital output signals in which said rotational speed of the crankshaft is classified into a plurality of sections corresponding to the number of said cylinders; and (b) a decoding means responsive to said coded digital output signals for producing a plurality of control signals according to a predetermined decoding process wherein the number of said control signals varies in response to said rotational speed of the crankshaft.

18. Apparatus as claimed in claim 17, wherein said first means comprises:

(a) means for producing a pulse signal responsive to the rotational speed of a crankshaft of said engine; and (b) a frequency to voltage converter responsive to said pulse signal for producing said first signal; and wherein said sixth means comprises a switching means responsive to said third signal interposed between said frequency to voltage converter and said analog to digital converter.

19. Apparatus as claimed in claim 17, wherein said analog to digital converter comprises:

(a) a plurality of voltage dividers the number of which being equal to the number of said cylinders, and the output voltages thereof being arranged stepwise; and (b) a plurality of comparators, each having inverting and noninverting inputs, the number of which being equal to the number of said cylinders, and each of the noninverting inputs thereof being commonly connected to the output of said first means, and each of the inverting inputs thereof being connected to the outputs of respective said voltage dividers.

20. Apparatus as claimed in claim 19, wherein said sixth means comprises a means for raising the output levels of said voltage dividers upon presence of said third signal.

21. Apparatus as claimed in claim 19 or claim 20, further comprising means for varying the output levels of said voltage dividers in accordance with engine temperature.

22. Apparatus as claimed in claim 20, further comprising means for disabling the stepwise increase of the enabled cylinders when the engine temperature is below a predetermined value.

23. Apparatus as claimed in claim 22, wherein said disabling means comprises a temperature detecting circuit for producing an output signal when the engine temperature is below a predetermined value and a switching circuit responsive to the output signal of said temperature detecting circuit, said switching circuit being interposed in the input circuit of said comparators except one comparator whose threshold level is the highest.

* * * * *